United States Patent [19]

Rainis

[11] 4,388,180

[45] Jun. 14, 1983

[54] METHOD FOR BENEFICIATION OF PHOSPHATE ROCK

[75] Inventor: Andrew Rainis, Walnut Creek, Calif.

[73] Assignee: Chevron Research Company, San Francisco, Calif.

[21] Appl. No.: 330,300

[22] Filed: Dec. 14, 1981

[51] Int. Cl.[3] ..... B03D 3/06

[52] U.S. Cl. ..... 209/5; 209/9; 210/725

[58] Field of Search ..... 264/117; 209/5, 49, 209/9, 166, 167; 210/710, 724, 725, 727; 44/15 R, 24

[56] References Cited

U.S. PATENT DOCUMENTS

| | | | |
|---|---|---|---|
| 3,661,254 | 5/1972 | Sirianni et al. | 209/5 |
| 4,080,176 | 3/1978 | Verschuur | 44/1 R |
| 4,229,293 | 10/1980 | Caswell et al. | 209/5 |
| 4,239,718 | 12/1980 | Dudt | 264/117 |
| 4,248,698 | 2/1981 | Keller | 209/5 |
| 4,270,927 | 6/1981 | Burk et al. | 209/5 X |
| 4,284,413 | 8/1981 | Capes et al. | 44/24 X |
| 4,323,365 | 4/1982 | Crosby et al. | 209/5 X |

OTHER PUBLICATIONS

Mehrotra et al., "Oil Agglomeration . . . Advantages", Mining Engineering, Aug. 1980, pp. 1230–1235.

*Primary Examiner*—Ralph J. Hill

*Attorney, Agent, or Firm*—D. A. Newell; S. R. LaPaglia; E. A. Schaal

[57] ABSTRACT

A process is disclosed which removes gangue minerals from phosphate rock by forming an aqueous slurry of phosphate rock and its impurities, then using a low boiling, nonpolar, water insoluble, bridging hydrocarbon to selectively agglomerate the phosphates.

4 Claims, No Drawings

METHOD FOR BENEFICIATION OF PHOSPHATE ROCK

BACKGROUND OF THE INVENTION

The present invention relates to a method of removing impurities from phosphate rock.

There are a variety of known techniques for removing impurities from solids, based on differences in characteristics between the pure solid and its impurities. For instance, materials can be separated based on their size, their density, their ability to hold an electrical charge, or their magnetic characteristics. These methods are useful for most solid separation applications, but there are some solids that cannot be economically separated by these methods because the pure solid and its impurities are too similar in these characteristics.

A solution to this problem is to use a different characteristic, such as affinity for water, to separate the solid from its impurities. In one known method, ash (a hydrophilic impurity) is separated from coal (a hydrophobic acid) by forming a coal slurry, mixing oil into the slurry to produce agglomerates, and recovering the agglomerates as product. Most of the ash remains in the aqueous phase of the slurry.

A major disadvantage of this method is that the oil used to agglomerate the coal becomes part of the product. This means that this process could not be used to separate other hydrophobic materials from their hydrophilic impurities whenever oil would not be a desirable part of the final product. It is possible to try to recover the oil from the agglomerates, but this would require extremely high temperatures (in excess of 260° C.) and, even at these high temperatures, the oil recovery would not be complete.

It would be advantageous if a separation method could separate gangue minerals from phosphate rock by a process more energy efficient than the prior art processes. It would also be advantageous if a separation method could separate gangue materials from phosphate rock without agglomerates being in the final product.

SUMMARY OF THE INVENTION

The present invention overcomes the deficiencies of the prior art by selective agglomeration of the phosphate rock. In the present invention, an aqueous slurry is formed of phosphate rock and gangue minerals; the pH of the slurry is adjusted to between 10 and 11; a surface conditioner is added to the slurry; a nonpolar, water insoluble, bridging hydrocarbon is used to selectively form agglomerates of phosphate; the agglomerates are separated from the slurry containing the gangue minerals; and the bridging hydrocarbon is recovered and recycled. An essential element of this invention is the bridging hydrocarbon used. It is essential that the bridging hydrocarbon have a low boiling point (70° C. or less), such as butane, pentane, hexane, and mixtures thereof. The surface conditioner may be oleic acid, fatty acids, or high molecular weight organic acids.

Preferably, the initial slurry of phosphate rock and gangue minerals should contain 10% to 20% by weight solids and the separation step should be carried out using a screening means or a centrifuge.

DESCRIPTION OF THE PREFERRED EMBODIMENTS

In its broadest application, the present invention involves removing gangue minerals from phosphate rock by forming an aqueous slurry of the phosphate rock and gangue minerals; then selectively agglomerating the phosphates in such a way as to agglomerate the phosphates, but not the gangue minerals. This selective agglomeration is carried out by the use of a nonpolar, water insoluble, bridging hydrocarbon. After the selective agglomeration takes place, the agglomerates can be separated by a screening device or a centrifuge, then the bridging hydrocarbon can be recovered and recycled.

In one particularly advantageous embodiment, phosphate rock is mixed with water to form an aqueous slurry wherein the phosphate rock and gangue minerals are dispersed in water and the resulting slurry has from 10% to 20% by weight solids; the pH of the slurry is adjusted to between 10 and 11; pentane and oleic acid are added to the slurry; then agglomerates of phosphates are formed; the phosphate agglomerates are separated from the slurry by passing the slurry through a screen and the phosphate agglomerates are heated in an inert atmosphere to remove the pentane; then the pentane is recovered from the inert atmosphere and this pentane is recycled.

The first step in this invention is forming an aqueous slurry of the phosphate rock and gangue minerals. Preferably, this slurry has a solids content of from 10% to 20% by weight and a particle size of less than 500 microns. The aqueous slurry can be formed by adding water to phosphate rock or phosphate slimes.

For effective beneficiation of phosphate rock, a surface conditioner must be added to the slurry prior to agglomeration. Effective surface conditioners include oleic acid, fatty acids, and high molecular weight organic acids. These surface conditioners activate the surface of the phosphates. For optimum results, the pH of the slurry should be between 10 and 11. Under these conditions, the surface conditioner is presumably adsorbed on the phosphate surface so that the bridging hydrocarbon can wet the surface of the phosphate particles and cause agglomeration.

An agglomerant is added to the slurry in order to selectively agglomerate the phosphate rock. This agglomerant is a low boiling, nonpolar, water insoluble hydrocarbon having a boiling point of 70° C. or less. This agglomerant may be butane, pentane, hexane, or a mixture thereof. The slurry should contain from 10% to 40% of agglomerant on an agglomerant and dry phosphate weight basis.

The agglomerant should be low boiling so that it can be readily recovered at low temperatures and can be recycled to reduce the agglomerant requirement. High boiling hydrocarbons, such as fuel oil, are hard to recover, even at temperatures of 260° C. and higher. If fuel oil is used as an agglomerant, extremely high temperatures are required to recover the agglomerant and these high temperatures represent a severe penalty in energy requirements. Even at these high temperatures, fuel oil recovery is incomplete. For these reasons, low boiling agglomerants are preferred over fuel oil. As a general rule, increases in agglomerant boiling point cause recovery of the agglomerant to be more difficult since the agglomerant is more strongly adsorbed on the phosphate surface.

The agglomerant should be nonpolar for a better distribution of the organic between the aqueous phase and the solid. As polarity increases, more agglomerant is lost in the aqueous phase.

The agglomerant should be a hydrocarbon, instead of other nonpolar, insoluble agglomerants such as freon, because these hydrocarbons are cheaper than other nonpolar agglomerants and because halogens in the product could cause problems downstream, such as corrosion.

Another advantage of these low-boiling agglomerants is that they have lower densities than other agglomerants. In agglomeration, there is an optimum volume of agglomerant that is needed to give good, easily separable agglomerates. The energy required to remove the agglomerant depends upon the weight present. Thus, if two liquids of equal heat of vaporization are used, the energy required to remove equal volumes will be less for the liquid of lower density.

For an agglomerant-free product, the agglomerant must be volatile, it must be recoverable at a reasonable temperature (30° C. to 70° C.), and it should not be strongly absorbed into the phosphate rock. The agglomerants of the present invention satisfy these criteria.

Preferably, the agglomerant is added with the surface conditioner to give a homogeneous feed (the conditioner is 5% or less by weight on phosphate and conditioner basis).

The phosphates are selectively agglomerated and the gangue minerals remain dispersed in the slurry. This selective agglomeration is carried out at low shear.

After the phosphate agglomerates are formed, they can be separated from the slurry by any known separation technique. Preferably, the agglomerates are removed from the slurry by using either a screen or a centrifuge. A sieve bend is a particularly advantageous screening means because of its low cost.

After the agglomerates are separated from the slurry, they are heated or flashed to remove the agglomerant. To maximize recovery of the agglomerant, the product leaving the heated zone should be discharged at a temperature in excess of the boiling point of the agglomerant. An inert atmosphere or vacuum should be used in the heating step to reduce the chance of the agglomerant from thermally decomposing.

An advantage of the present invention is that the low boiling agglomerants of the present invention do not require high temperatures in order to be removed, thus saving energy.

The agglomerant is then recovered from the inert atmosphere and is recycled. In one agglomerant recovery process, the agglomerant and the inert gas are passed through a bag filter for dust removal, then the agglomerant and inert gas are passed through a compressor and a agglomerant recovery condenser, which recovers the agglomerant from the gas. The gas leaving the condenser is passed through a carbon adsorption system which further removes agglomerant. The agglomerant is then recycled as a source of make-up agglomerant for the premixer and the inert gas is recycled to the heating zone.

EXAMPLES

The invention will be further illustrated by the following examples which set forth particularly advantageous method embodiments. While the examples are provided to illustrate the present invention, they are not intended to limit it.

EXAMPLE I

A series of runs were made using an unweathered western phosphate rock. In each run, an unweathered western phosphate rock having a particle size distribution such that 50% of the particles are less than 400 mesh, and containing 20.73 weight percent $P_2O_5$, was mixed with water to form an aqueous slurry; the pH of the slurry was adjusted to a particular level; oleic acid and hexane were used to selectively form agglomerates of phosphate; the phosphate agglomerates were separated from the slurry; and the agglomerates were heated in an inert atmosphere to remove the hexane. The results of these runs are shown in the following table.

Effect of pH on $P_2O_5$ Recovery From Unweathered Western Phosphate Rock

| Product Grade (Wt. % $P_2O_5$) | $P_2O_5$ Recovery (WT. %) | pH |
|---|---|---|
| 30.26 | 21.2 | 7.2 |
| 28.32 | 43.0 | 7.5 |
| 29.58 | 42.2 | 7.5 |
| 30.04 | 46.2 | 9.1 |
| 31.04 | 76.4 | 11.0 |
| 30.09 | 70.7 | 11.9 |

Thus, in operation, selective agglomeration of phosphate using hexane as an agglomerant is an effective means of beneficiation of phosphate rock, but such beneficiation must occur at a pH of at least 10.

While the present invention has been described with reference to specific embodiments, this application is intended to cover those changes and substitutions which may be made by those skilled in the art without departing from the spirit and scope of the appended claims.

I claim:

1. A method of removing gangue minerals from phosphate rock comprising:

(a) forming an aqueous slurry of gangue mineral containing phosphate rock;

(b) adjusting the pH of the slurry to between 10 and 11;

(c) adding to said slurry a surface conditioner selected from the group consisting of oleic acid, fatty acids, and high molecular weight organic acids;

(d) using a nonpolar, water insoluble, bridging hydrocarbon having a boiling point of less than 70° C. to selectively form agglomerates of phosphates;

(e) separating the agglomerates of phosphates from the slurry containing the gangue minerals;

(f) recovering the bridging hydrocarbon; and (g) recycling the bridging hydrocarbon to step (d).

2. A method of removing gangue minerals from phosphate rock according to claim 1 wherein the bridging hydrocarbon is selected from the group consisting of butane, pentane, hexane, and mixtures thereof.

3. A method of removing gangue minerals from phosphate rock according to claim 1 wherein said slurry in step (a) has from 10% to 20% by weight solid content.

4. A method of removing gangue minerals from phosphate rock according to claim 1 wherein the separation step (e) is carried out using either a screening means or a centrifuge.

* * * * *

UNITED STATES PATENT AND TRADEMARK OFFICE

CERTIFICATE OF CORRECTION

PATENT NO. : 4,388,180

DATED : June 14, 1983

INVENTOR(S) : ANDREW RAINIS

It is certified that error appears in the above-identified patent and that said Letters Patent are hereby corrected as shown below:

Col. 1, Line 23, "hydrophobic acid" should read -- hydrophobic solid--

Signed and Sealed this

*Twenty-third* Day of *August 1983*

[SEAL]

*Attest:*

GERALD J. MOSSINGHOFF

*Attesting Officer*

*Commissioner of Patents and Trademarks*